US005482205A

United States Patent [19]

Drummond et al.

[11] Patent Number: 5,482,205

[45] Date of Patent: Jan. 9, 1996

[54] SPIRALLY-WOUND EASY-OPEN CONTAINER HAVING A SCORE CUT OPENING PANEL

[75] Inventors: Michael T. Drummond, Florence; William C. Suski; Calvin G. Hill, both of Hartsville; James W. Lowry, Florence, all of S.C.; Rodney W. Roberts, Otisco, Ind.

[73] Assignee: Sonoco Products Company, Hartsville, S.C.

[21] Appl. No.: 283,648

[22] Filed: Aug. 1, 1994

[51] Int. Cl.[6] ..... B65D 85/00

[52] U.S. Cl. ..... 229/201; 229/4.5; 229/198.2

[58] Field of Search ..... 229/4.5, 198.2, 229/201, 202, 205, 208, 940

[56] References Cited

U.S. PATENT DOCUMENTS

| | | | |
|---|---|---|---|
| 2,775,394 | 12/1956 | Lucas, Jr. . | |
| 2,775,395 | 12/1956 | Bergstrom . | |
| 2,855,884 | 10/1958 | Magill . | |
| 2,858,057 | 10/1958 | Mullinix . | |
| 3,009,626 | 11/1961 | Johnson . | |
| 3,140,808 | 7/1964 | Taylor . | |
| 3,144,193 | 8/1964 | Geist et al. | 229/4.5 |
| 3,153,506 | 10/1964 | Pottle | 229/202 |
| 3,182,891 | 5/1965 | Ecklund et al. . | |
| 3,185,577 | 5/1965 | Krause . | |
| 3,241,739 | 3/1966 | Ahlemeyer | 229/202 |
| 3,441,197 | 4/1969 | White | 229/202 |
| 3,510,050 | 5/1970 | Culley et al. | 229/202 |
| 3,981,433 | 9/1976 | Thornhill et al. | 229/4.5 |
| 4,073,950 | 2/1978 | Hansen et al. | 229/4.5 |
| 4,187,137 | 2/1980 | Beauchamp | 229/4.5 |
| 5,076,440 | 12/1991 | Drummond . | |
| 5,251,809 | 10/1993 | Drummond et al. . | |

*Primary Examiner*—Gary E. Elkins
*Attorney, Agent, or Firm*—Bell, Seltzer, Park & Gibson

[57] ABSTRACT

An easy-open container has a spirally-wound paperboard bodywall layer, interior barrier liner layer and outer label layer forming as easy-open seam extending spirally between the ends of the container. Easy-opening of the container is enhanced by the provision of pull tabs formed by superimposed and bonded longitudinal edge portions of the bodywall layer and label layer and an easy-open panel formed by diverging lines of score cuts formed in the bodywall layer to initiate and aid in easy-opening of the container along the spiral seam.

10 Claims, 4 Drawing Sheets

SPIRALLY-WOUND EASY-OPEN CONTAINER HAVING A SCORE CUT OPENING PANEL

FIELD OF THE INVENTION

This invention relates to an easy-open container for packaging various products, particularly products under pressure such as biscuit and bread dough and the like and method of manufacturing such container. More specifically, this invention relates to an easy-open container having a spirally-wound bodywall layer forming an easy-open seam extending spirally between the ends of the container, an interior barrier liner layer, and an outer label layer, and being provided with tab cuts and score cuts through the bodywall layer for providing an easy-open pull tab and panel for opening of the container.

BACKGROUND AND SUMMARY OF THE INVENTION

Easy-open composite container for packaging various products, particularly products under pressure such as refrigerated dough products and the like, constitute a significant commercial consumer product. These containers are usually formed of a spirally-wound paperboard or board stock bodywall layer, an interior or liner layer for preventing leakage of the contents from the container and an exterior label layer. The bodywall layer is wound in such a manner as to form a spiral easy-open seam extending from one end of the container to the other end of the container. When the outer label layer is either totally removed or that portion bridging the spiral seam of the bodywall layer is torn away from the spiral seam, the pressurized dough product expands outwardly and causes the spiral seam of the bodywall layer to open, in a manner well understood by those with ordinary skill in the art. This allows access to the dough and the interior of the container through the spiral easy-open seam in the container.

Various problems have been associated initiating easy-opening of the spiral seam so as to obtain access to the interior of the container. Many mechanism have been suggested to assist in the opening of the spiral seam. These include different constructions of tear strips associated with the easy-open spiral seam, selection of materials, placement of adhesives, etc. However, there still exists a need to improve the initiation and easy-opening of the spiral seam in these types of containers for pressurized food products and the like.

Accordingly, it is the object of this invention to provide a spirally-wound easy-open container for packaging various products, particularly products under pressure, and which provides an improved construction for easy-opening of the container and a method of manufacturing such container.

It has been found by this invention that this object may be accomplished by providing an easy-open container, and method of manufacturing same, particularly adapted for packaging products under pressure and which is spirally-wound and which includes a score cut opening panel therein for aiding in initiating opening of the easy-open spiral seam and which has the following components and features.

A paperboard bodywall layer in strip form is spirally-wound and defines a substantially cylindrical container having opposed ends. The bodywall layer has longitudinal edges lying adjacent each other and forming a butt joint or an overlapped skived edge joint to thereby define an easy-open spiral seam extending between the opposed ends of the container.

A flexible barrier liner layer in strip form is spirally-wound inside the bodywall layer in superimposed position therewith. The liner layer preferably includes an expandable joint comprising longitudinal edge portions overlapped with each other, an expandable fold formed by one of the liner layer edge portions being folded on itself and low strength bonding means positioned between the liner layer overlapped edge portions. The liner layer expandable joint is preferably positioned adjacent to and to one side of the easy-open spiral seam. High strength bonding means is preferably positioned between the liner layer and the bodywall layer except in the area between the liner layer expandable joint and slightly beyond the other side of the easy-open spiral seam from the liner layer expandable joint.

A flexible label layer in strip form is spirally-wound outside the bodywall layer in superimposed position therewith and has longitudinal edge portions overlapped with each other adjacent and to one side of the easy-open spiral seam. The uppermost of the label layer overlapped edge portions is positioned in bridging relation to the easy-open spiral seam. Preferably, this uppermost label layer overlapped edge portion is folded under on itself and high strength bonding means is positioned between the folds formed therein. High strength bonding means is also positioned between the label layer and the bodywall layer.

Tab cuts extend through this uppermost label layer edge portion and inwardly from an outer edge thereof past the spiral seam and through the bodywall layer longitudinal edge portion superimposed thereunder to define an easy-open pull tab including both the upper of the label layer edge portions and the inwardly underlying bodywall layer longitudinal edge portion. Score cuts extend through the bodywall layer and extend in diverging lines from the pull tab to define an easy-open panel for the container which is adapted to tear when the pull tab is pulled to easy-open the container.

The low strength bonding means described above preferably comprises a frangible adhesive and the high strength bonding means described above preferably comprises a permanent adhesive.

Thus, an easy-open container is formed which has a pull tab defined by tab cuts in both the superimposed label layer and bodywall layer extending inwardly from the overlapped longitudinal edges of the label layer for easy gripping when opening of the container is desired. This pull tab extends into a score cut opening panel in the bodywall layer which allows easy-opening of the container by opening-up a section of the bodywall layer when the panel is torn to expose the spiral seam and allow the pressurized food product in the container to expand and rupture the expandable joint in the liner layer to provide access to the user to the interior of the container.

While score cut panels have been utilized for opening of convolutely-wound containers, these convolutely-wound containers are less desirable for pressurized food products, such as biscuit and bread dough and the like, since they provide vertical or longitudinal bodywall edge seams which present poor graphic appearances and often allow wicking of moisture, etc. into or out of the container. These convolutely-wound containers usually require multiple convolute wraps or layers of the bodywall material to hold the container together and prevent premature opening. This also is not desirable from an economics standpoint. The use of such score cut easy-open panels for initiating opening of a spirally-wound container along an easy-open spiral seam has not heretofore been considered. Inherent problems are involved in forming cuts and score lines in bodywall layer strips being fed at acute angles for spiral-winding on a mandrel and to provide superimposed alignment of cut pull tabs in the bodywall layer and in the label layer. However, these problems have been overcome by the method of manufacture in the present invention by utilizing rotary dye cutting while controlling tension and feed of the various strips of material to the mandrel.

BRIEF DESCRIPTION OF THE DRAWINGS

In the drawings which form a part of the original disclosure of the invention.

DETAILED DESCRIPTION OF PREFERRED EMBODIMENTS

Figure 1:
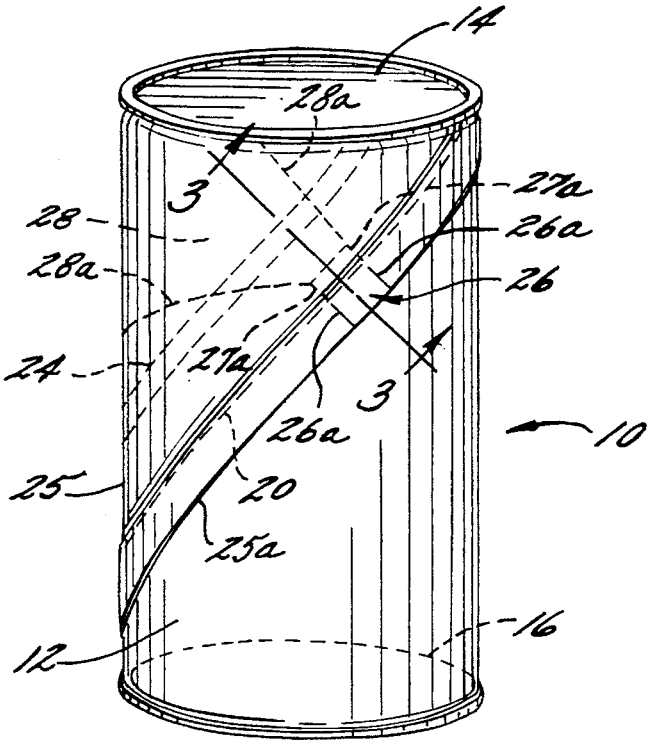
FIG. 1 is a perspective view of a spirally-wound easy-open container provided according to a preferred embodiment of this invention.
Figure 2:
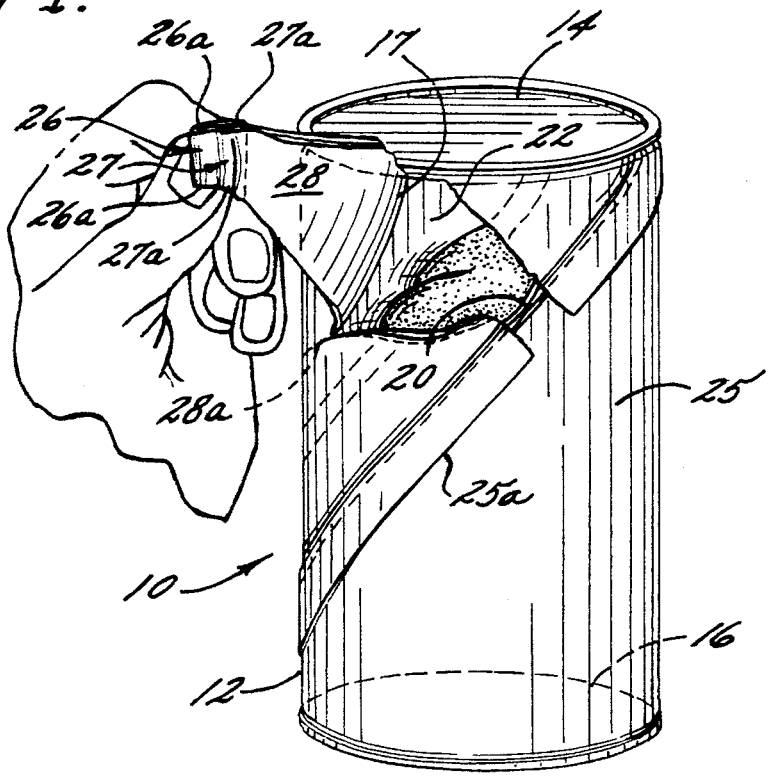
FIG. 2 is a perspective view of the easy-open container of FIG. 1 illustrating the easy-opening of the container.

In the following detailed description, various preferred embodiments of the invention are described. It will be understood, however, that the invention is not to be limited to its preferred embodiments and although specific terms are employed in describing these preferred embodiments, these are for purposes of illustration only and not for purposes of limitation. It will thus be apparent that the invention includes various alternatives, modifications and equivalents within its spirit and scope as will be apparent to the skilled artisan.

FIGS. 1–4 illustrate a preferred embodiment of an easy-open container 10 constructed in accordance with the present invention. The container 10 includes a generally cylindrical body portion 12, a top end closure 14 and a bottom end closure 16.

The container 10 further includes a spirally-wound paperboard bodywall layer 17 in strip form which forms the basic shape of the cylindrical body portion 12 of the container 10. The bodywall layer 17 has longitudinal edge portions **17*a* lying adjacent each other and defining an easy-open spiral seam 20 extending between the opposed ends of the body 12 and between the enclosures 14 and 16 of the container 10. In accordance with the embodiment of container illustrated in FIGS. 1–4, the longitudinal edges 17*a* of the bodywall layer 17 abut each other to form a butt joint to in turn define the spiral seam 20**.

This bodywall layer 17 may be advantageously composed of conventional spiral-winding paperboard or board stock having a thickness of between 0.010 and about 0.035 inch, preferably between about 0.015 and 0.030 inch, for example 0.021 inch. The board stock conventionally used in the manufacture of spirally-wound containers is commercially available from various manufacturers including Sonoco Products Company, Republic Paperboard Corporation and Middletown Board Corporation. In order to function advantageously as the spirally-wound bodywall layer, the board stock typically is composed of kraft or recycled paper and can typically range from e.g. 50 to 100 lbs./ream. In some instances the board stock can include a weak exterior layer, e.g. a 0.003 inch exterior news.

The easy-open container 10 further includes a flexible barrier liner layer 22 in strip form spirally-wound inside the bodywall layer 17 in superimposed position therewith. The liner layer 22 preferably has an expandable joint 24 comprising liner layer longitudinal edge portions **22*a* overlapped with each other and wherein an expandable fold is formed by one of the liner layer edge portions being folded on itself, preferably the lowermost, and low strength bonding means, preferably in the form of a heat seal, being positioned between the liner layer overlapped edge portions 22*a*. This liner layer expandable joint 24 is positioned adjacent to and to one side of the easy-open spiral seam 20 and in the direction of opening of the spiral seam 20, as shown particularly in FIG. 4. This liner layer 22** may advantageously be a barrier type, flexible sheet material, such as a polymer/foil, a kraft/foil/polymer, a polymer/polymer, or a kraft/foil laminate.

Figure 3:
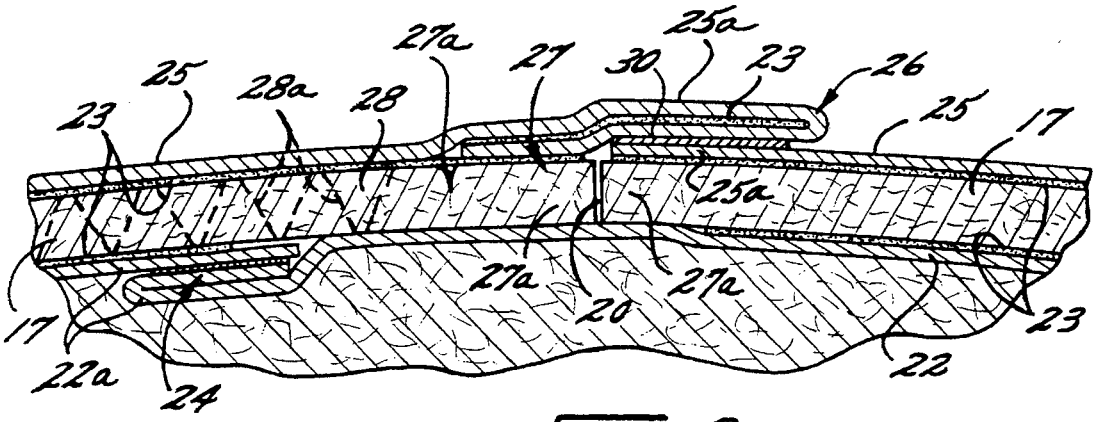
FIG. 3 is a greatly enlarged fragmentary sectional view taken generally along the line 3—3 of FIG. 1 and illustrating one embodiment of an easy-open seam of the bodywall of the container along with the associated construction of the liner layer and label layer.
Figure 4:
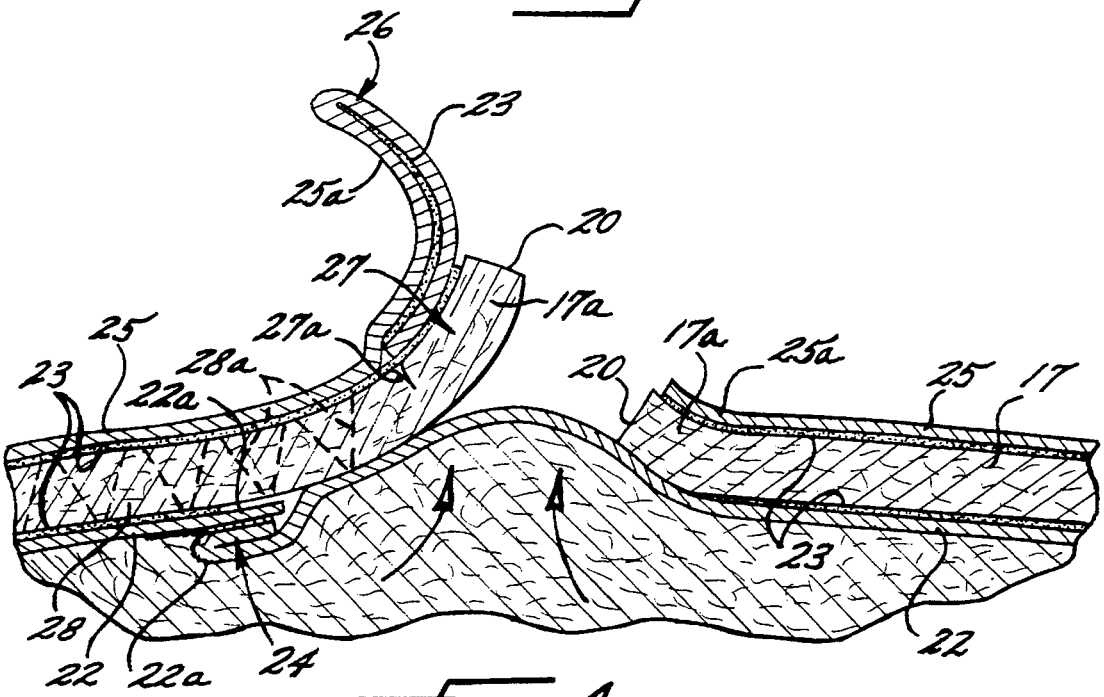
FIG. 4 is a cross-sectional view, like FIG. 3, illustrating the manner in which the container is easy-opened.

High strength bonding means 23, preferably in the form of a permanent adhesive, may be positioned between the liner layer 22 and the bodywall layer 17, except in the area between the liner layer expandable joint 24 and slightly beyond the other side of the easy-open spiral seam 20 from the liner layer expandable joint 24, as shown particularly in FIG. 3. The liner layer 22 prevents the escape of liquids, oils and, preferably, gases into and out of the container bodywall layer 17 from the interior of the container 10 and expands through the easy-open spiral seam 20 during opening of the container 10, as will be discussed in more detail below.

The container 1O further includes a flexible label layer 25 in strip form spirally-wound outside the bodywall layer 17 in superimposed position therewith and having longitudinal edge portions **25*a* overlapped with each other adjacent to and to one side of the easy-open spiral seam 20. Low strength bonding means 30, preferably in the form of a frangible adhesive, is positioned between the overlapped label layer edge portions 25*a*. The uppermost of the label layer overlapped edge portions 25*a* is folded under on itself and has high strength bonding means 23, preferably in the form of a permanent adhesive, positioned between the folds formed therein. The folded uppermost of the label layer overlapped edge portions 25*a* is positioned in bridging relation to the easy-open spiral seam 20, as shown particularly in FIG. 3. The label layer 25** is conventionally constructed from suitable materials, such as kraft paper, a polymer, a polymer/polymer laminate, a polymer/foil laminate, a kraft paper/foil laminate or the like.

High strength bonding means 23, preferably in the form of a permanent adhesive, is positioned between the label layer and the bodywall layer.

The easy-open container 10 further includes tab cuts 26*a* extending through the upper overlapped label layer edge portion 25*a* and inwardly from an outer edge thereof past the spiral seam 20 to define a tear tab 26 in the label layer 25 which can be easily lifted open and pulled by the user to initiate easy-opening of the container 10 in a manner to be described below. Tab cuts 27*a* are also formed through the bodywall layer longitudinal edge portion superimposed under the upper of the label layer edge portions 25*a* and in the direction of opening of the spiral seam 20 to define a tear tab 27 in the bodywall layer 17 which is superimposed under the tear tab 26 in the label layer 25 and is bonded thereto by the high strength bonding means 23, preferably in the form of permanent adhesive, positioned between the label layer 25 and the bodywall layer 17, as described above. This construction provides easy-open pull tabs 26, 27 including both the upper of said label layer edge portions 25*a* and the inwardly underlying bodywall layer longitudinal edge portion 17*a* for initiating easy-opening of the spiral seam 20, in a manner to be described more fully below.

The container 10 further includes score cuts 28*a* extending through the bodywall layer 17 and extending in diverging lines from the pull tab formed by the tab cuts 27*a* to define an opening panel 28 for the container which is adapted to tear when the pull tabs 26, 27 are pulled to easy-open the container 10. The diverging lines of score cuts 28*a* forming the easy-open panel preferably extend at angles between about 0 degrees to 45 degrees and about 90 degrees to 110 degrees, respectively, from the longitudinal edge having the tab cuts 27 extending inwardly therefrom to define an included angle from about 45 degrees to 90 degrees in the opening panel.

With the above construction of container such container may be easy-opened by grasping and pulling the tear tabs 26, 27. Since these tear tabs 26, 27 are bonded together by permanent adhesive they will be pulled together away from the liner layer 22 which is not bonded thereto in this area. As the pull tabs 26, 27 are pulled away from the container 10, it will also pull the opening panel 28 formed by the diverging lines of score cuts 28*a* to in turn open up the spiral seam 20 and allow the expandable joint 24 of the liner layer 22 to expand and ultimately rupture allowing the pressurized dough or other food product in the container 10 to push out of the spiral seam 20 and open the container in a manner well understood by those with ordinary skill in the art.

Figure 5:
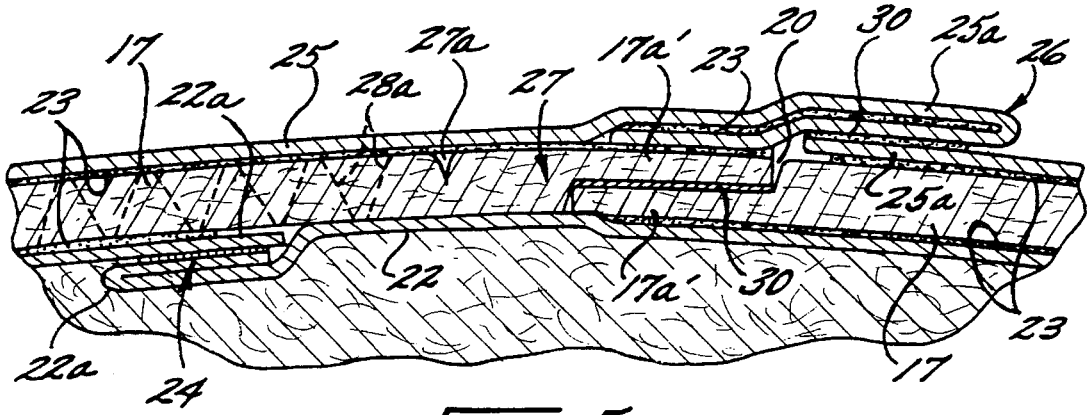
FIG. 5 is a cross-sectional view, like FIG. 3, illustrating another embodiment of the spiral seam.
Figure 6:
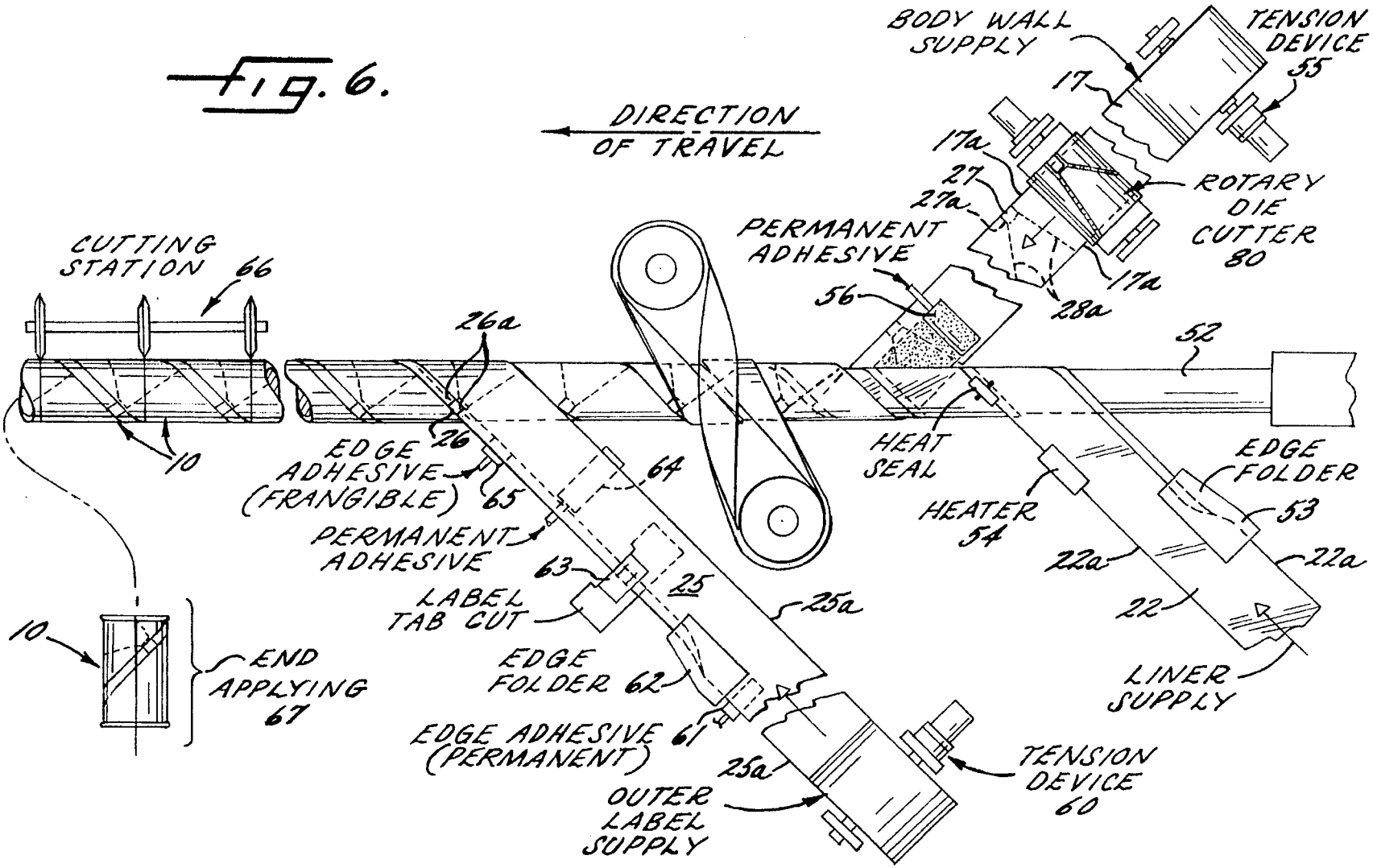
FIG. 6 is a diagrammatic view illustrating a preferred method and apparatus for producing the easy-open container of this invention.

Referring now to the embodiment of the container 10 shown in FIG. 5, like reference numerals are used in this embodiment where the components of this alternative embodiment of the container 10 are the same and will not be further described with respect to this embodiment.

In this embodiment of the container 1O of FIG. 5, the longitudinal edges 17*a*' of the bodywall layer 17 are in the form of longitudinal skived edges and are overlapped with each other. Skived edges, as is well understood by those with ordinary skill in the art, may be formed by compressing the edges or by grinding away or cutting away a portion of the material of the edges. The skived edges illustrated in FIG. 5 are compression skived. Preferably, a low strength bonding means 30, in the form of a frangible adhesive, is positioned between the overlapped skived edges 17*a*'. This embodiment provides additional strength to the spiral seam 20.

Various adhesives may be employed to provide the permanent adhesive utilized for the high strength bonding means 23. The tear or peel strength of this permanent adhesive will vary depending upon the materials used in the component layers of the container 10. The tear or peel strength must be greater than the tear strength of the liner layer 22 and the label layer 25 so that these layers will tear rather than separate when easy-opening of the container 1O. With current materials used for these component layers, it has been found that a peel strength greater than 2.20 lbs. per square inch is necessary. The permanent adhesive may include polyvinyl alcohol with or without clay mix, blended or reactor resins, special additives, such as manufactured by H. B. Fuller and identified as A1940 having 4000 CPS viscosity, 55% solids and 5.0 pH, K6030 having 3050 CPS viscosity, 55% solids and 5.0 pH, H3935 having 5500 CPS viscosity, 52% solids and 5.0 pH, and by National Starch and identified as 32-1984 having 5400 CPS viscosity, 56% solids and 4.5 pH, and 32-0215 having 4500 CPS viscosity, 55% solids and 4.0 pH.

Various adhesives can be employed as the frangible adhesive forming the low strength bonding means 30. The tear or peel strength of this frangible adhesive will vary depending on the materials used in the component layers of the container 10. The peel strength must be weak or less than the tear strength of the liner layer 22 and the label layer 25 so that the layers will peel to separate rather than tear. With current material used, it has been found that a peel strength of 0.42 to 1.99 pounds per square inch is preferred. The frangible adhesive may include a high initial tack dextrine based adhesive commercially available from National Starch and Chemical Corporation, Grand Prairie, Tex. as "71-5626B". This is a high solids (about 64%), high viscosity (about 2100 cps) acid modified (about 2.5 Ph) dextrine adhesive. Other frangible adhesives which can be successfully used include heavily filled, resinous, aqueous emulsion type adhesives such as, for example polyvinylacetate dispersed in water together with a tackifying alcohol and an inert filler such as clay, silicon dioxide calcium carbonate, talc and the like. The inert filler can insure that a weak discrete layer of adhesive remains between the superimposed components of the container to thereby provide for the fracture or breaking of the adhesive. In the alternative, a release coating, such as a microcrystalline wax, silicone or the like can be provided on the inner surface on either or both of the superimposed components of the container so that the adhesive layer is readily released upon drying.

It is important that the frangible adhesive used for the low strength bonding means 30 have a high initial tack or adhesive so that the overlapped components between which it is positioned are held together during, and immediately following, manufacture of the container 10. It is also important that this frangible adhesive be capable of readily allowing peeling or separating of the superimposed components between which it is positioned upon easy opening of the container 10.

Referring now to FIGS. 6–9, a preferred method and apparatus are diagrammatically illustrated and are suitable for producing the easy-open container of this invention. As may be seen in FIG. 9, a flexible barrier liner layer 22 in strip form is provided from any suitable source of supply and is fed at a desired angle to a rotating mandrel 52 of a suitable tube spiral winding machine for being spirally-wound on the mandrel 52 to form overlapping liner layer edge portions 22*a* in a manner well understood by those with ordinary skill in the art. While the liner layer 22 is being fed to the mandrel 52, one of the edge portions 22*a* thereof is folded over on itself by an edge folder 53 to form a pleat. Also, while the liner layer 22 is being fed to the mandrel 52, a heater device 54 heats the other longitudinal edge portion 22*a* of the liner layer 22 so that when these liner layer edge portions 22*a* are overlapped with each other, a low strength bonding means 30 in the form of a heat seal will be positioned between such overlapped liner layer edge portions 22*a* to form the expandable joint 24.

A paperboard bodywall layer 17 in strip form is provided from any suitable source of supply and is fed at a desired angle to the mandrel 52 for being spirally-wound onto the spirally-wound liner layer 22 on the mandrel 52 while positioning the longitudinal edges of the bodywall layer 17 in either butt joint edge relationship or overlapped skived edge relationship to form a tube having a spiral seam 20 extending the length thereof in a manner well understood by those with ordinary skill in the art. Tension on the bodywall layer strip 17 is controlled by a suitable tension control device 55 as the bodywall layer strip 17 is being fed to the mandrel While the bodywall layer strip 17 is being fed to the mandrel 52, spaced tab cuts 27*a* are being formed through the bodywall layer 17 which extend inwardly from one outer longitudinal edge portion 17*a* to define the easy-open pull tab 27. Also, diverging lines of score cuts 28*a* are formed through the bodywall layer strip 17 and each extend inwardly from respective tab cuts 27*a* to the other outer longitudinal edge 17*a* of the bodywall layer strip 17 to define the easy-open panel 28. Illustrated in FIG. 9, one diverging line of score cuts 28 may be preferably formed at an included angle of about 40 degrees with the longitudinal edge portion 17*a* and the other diverging line of score cuts 28 may be preferably formed at a included angle of about 96 degrees with the longitudinal edge portion so that the included angle between diverging lines of score cuts 28*a* is preferably about 56 degrees.

Figure 7:
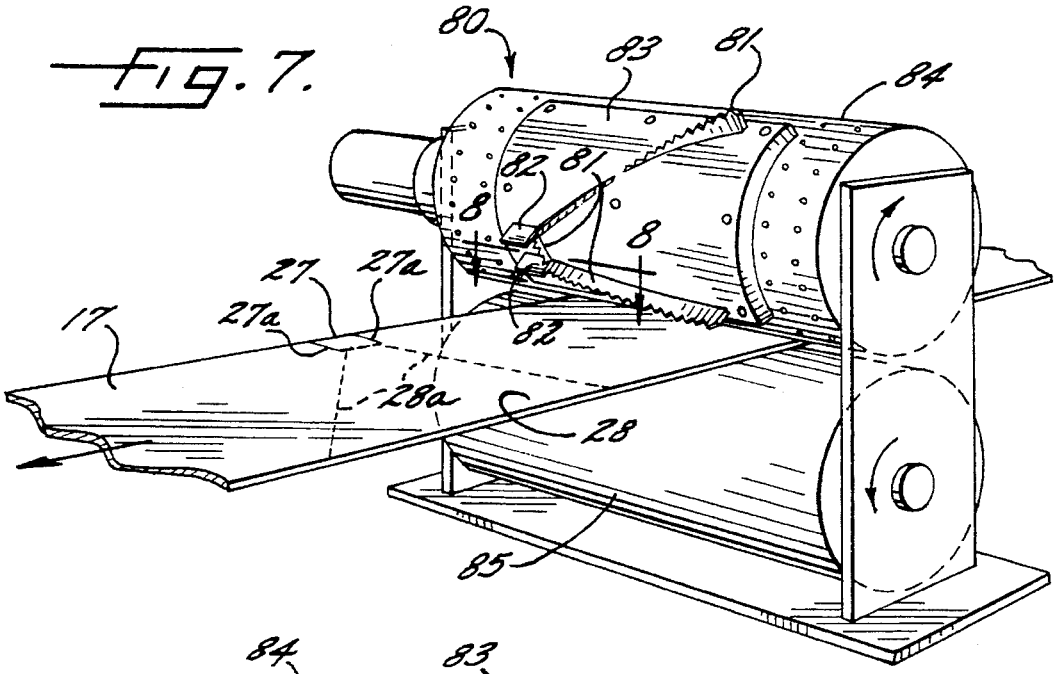
FIG. 7 is a perspective view of dye cutting apparatus utilized for cutting the tab cuts and score cuts in the bodywall layer to form the easy-open pull tab and score cut panel.
Figure 8:
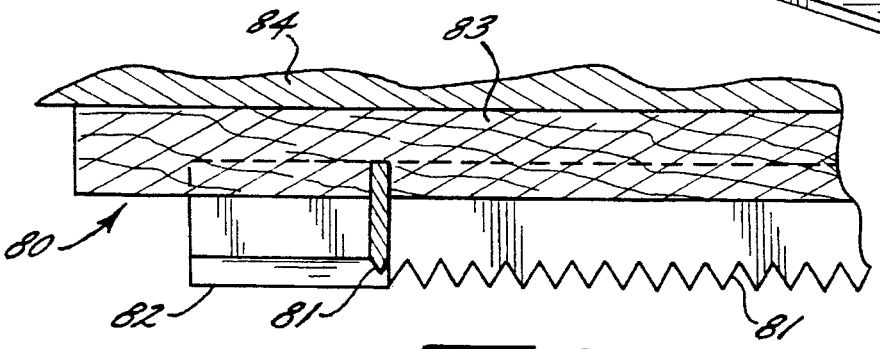
FIG. 8 is a greatly enlarged partial sectional view taken generally along the line 8—8 through the apparatus of FIG. 7.
Figure 9:
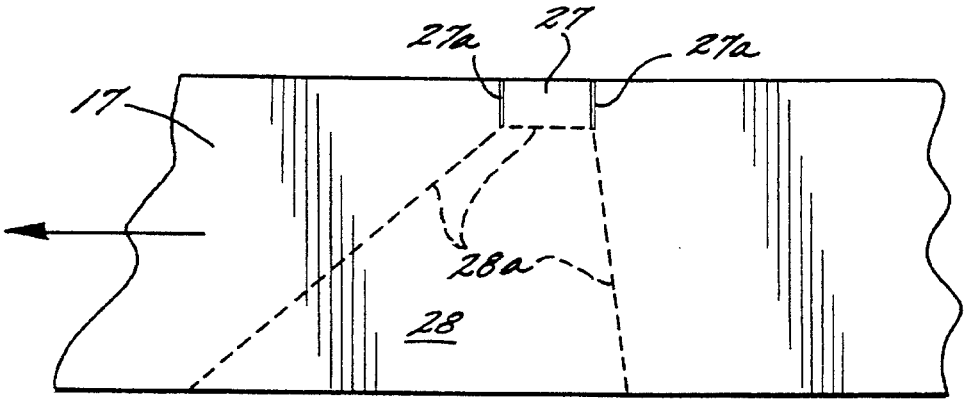
FIG. 9 is a top plan view of the bodywall layer strip having the dye cut tab cuts and score cuts forming the pull tab and easy-open panel.

These tab cuts 27*a* and score cuts 28 *a* may preferably be formed by a rotary die cutter mechanism 80, as illustrated particularly in FIGS. 7 and 8. This rotary die cutter 80 may be of conventional construction with perforated blades 81 and knife blades 82 positioned in the desired configuration on a plate 83 which is in turn removably secured to a rotating roller 84. The rotating roller 84 is adapted to rotate against a backup or anvil roller 85 to rotary die cut the tab cuts 27 and score cuts 28 in a manner well understood by those with ordinary skill in the art. Controlling of the tension during feed of the bodywall layer strip 17 by the tension device 55 correctly positions the tab cuts 27*a* and score cuts 28*a* along the bodywall layer strip 17.

Additionally, while the bodywall layer strip 17 is being fed to the mandrel 52 and after rotary die cutting of the tab cuts 27*a* and score cuts 28*a*, a high strength bonding means 23 in the form of a permanent adhesive is applied by an adhesive applicator device 56 along the upper surface of the bodywall layer strip 17, except in the area of the surface of the bodywall layer strip which is spirally-wound onto the expandable joint 24 formed by the overlapped longitudinal edges 22*a* of the liner layer 22, so that the bodywall layer 17 will be bonded to the liner layer 22, except in the area of the expandable joint.

A label layer strip 25 is provided from a suitable source of supply and is fed at a desired angled to the mandrel 52 for spirally-winding thereof onto the outer surface of the tube formed by the spirally-wound body layer 17 and liner layer 22 as such tube is moving forward on the mandrel 52. Tension on the label layer strip 25 is controlled by a suitable tension control device 60 as the label layer strip 25 is being fed to the mandrel 52. While the label layer 25 is being fed to the mandrel 52, one of the longitudinal edge portions 25*a* is coated on its undersurface with a high strength bonding means 23 preferably in the form of a permanent adhesive by an adhesive applicator 61. This label layer edge portion 25*a* is folded under onto itself by an edge folder 62 to position the high strength bonding means between folded over layers. This folded over and bonded edge portion 25*a* is then fed past a tab cutting device 63 for cutting spaced tab cuts 26*a* in the folded over longitudinal edge portion 25*a* to form the pull tab 26.

Thereafter and while the label layer strip 25 is being fed to the mandrel 52, a high strength bonding means 23 preferably in the form of a permanent adhesive is applied to the bottom surface of the label layer strip 25 by an adhesive applicator 64, while leaving an edge portion of the one outer longitudinal edge 25a having the tab cuts 26a therein free of such high strength bonding means. Thereafter, a low strength bonding means 30 preferably in the form of a frangible adhesive is applied by an adhesive applicator 65 along a bottom surface of the one folded under longitudinal edge portion 25*a* so that when the label layer strip 25 is spirally-wound with overlapping longitudinal edge portions 25*a*, a low strength bonding means 30 in the form of a frangible adhesive will be positioned between such overlapped edge portions 25*a*. Control of the tension during the feed of the label layer strip 25 by the tension device 60 will ensure proper positioning of the pull tab 26 in the label layer strip 25 and positioning thereof in superimposed position on the pull tab 27 formed in the bodywall layer 27.

The thus spirally-wound continuous tube having bodywall layer 17, liner layer 22 and label layer 25 are moved forwardly on the mandrel 52 to a cutting station 66 where suitable cutting devices cut the continuous tube into individual lengths for containers 10. The individual containers 10 may then be fed to end applying mechanisms 67 in a manner well understood by those with ordinary skill in the art.

Thus, it may be seen, that this invention has provided an easy-open container 1O and method of forming same, for packaging various products, particularly products under pressure, and which provides easy-open pull tabs 26, 27 formed by bonded portions of the outer longitudinal edge 25*a* of the label layer 25 and the superimposed longitudinal edge portion 17*a* of the bodywall layer 17 and an opening panel 28 formed by diverging lines of score cuts 28*a* formed in the bodywall layer 17 and extending from the pull tabs 26, 27 so that the opening panel 28 may be torn to expose the easy-open spiral seam 20 in the bodywall layer 17 and the underlying liner layer 22 and expansion joint 24 formed by overlapping longitudinal edge portions 22*a* therein. A method has been provided which may be utilized on conventional spiral-winding equipment with the use of a rotary die cutting mechanism 80 therein and which relies upon suitable tension devices 55, 60 for controlling the spiral-winding of the bodywall layer strip 17 and label layer strip 25 onto the mandrel 52.

This invention has been described in considerable detail with reference to its preferred embodiments. However, variations and modifications can be made within the spirit and scope of the invention as described in the foregoing specification and as defined in the following claims.

What is claimed is:

1. An easy-open container particularly adapted for packaging products under pressure and comprising:

a spirally-wound paperboard bodywall layer in strip form defining a substantially cylindrical container having opposed ends, said bodywall layer having longitudinal edges lying adjacent each other to thereby define an easy-open spiral seam extending between said opposed ends;

a flexible barrier liner layer in strip form spirally-wound inside said bodywall layer in superimposed position therewith;

a flexible label layer in strip form spirally-wound outside said bodywall layer in superimposed position therewith and having longitudinal edge portions overlapped with each other adjacent and to one side of said easy-open spiral seam, the uppermost of said label layer overlapped edge portions being positioned in bridging relation to said easy-open spiral seam;

high strength bonding means positioned between said label layer and said bodywall layer;

tab cuts extending through the upper of said label layer edge portions and inwardly from an outer edge thereof past said spiral seam and through said bodywall layer longitudinal edge portion superimposed thereunder to define an easy-open pull tab including both the upper of said label layer edge portions and the inwardly underlying bodywall layer longitudinal edge portion; and score cuts extending through said bodywall layer and extending in diverging lines from said pull tab to define an easy-open panel for said container which is adapted to tear when said pull tab is pulled to easy-open said container.

2. An easy-open container, as set forth in claim 1, in which said liner layer has an expandable joint comprising longitudinal edge portions overlapped with each other, an expandable fold formed by one of said liner layer edge portions being folded on itself, and low strength bonding means positioned between said liner layer overlapped edge portions.

3. An easy-open container, as set forth in claim 2, in which said liner layer expandable joint is positioned adjacent and to one side of said easy-open spiral seam and in the direction of tear of said easy-open panel defined by said score cuts.

4. An easy-open container, as set forth in claim 3, in which high strength bonding means is positioned between said liner layer and said bodywall layer except in the area between said liner layer expandable joint and slightly beyond the other side of said easy-open spiral seam from said liner layer expandable joint.

5. An easy-open container, as set forth in claim 1, in which the uppermost of said label layer overlapped edge portions is folded under on itself and in which high strength bonding means is positioned between the folds formed therein.

6. An easy-open container particularly adapted for packaging products under pressure and comprising:

a spirally-wound paperboard bodywall layer in strip form defining a substantially cylindrical container having opposed ends, said bodywall layer having longitudinal edges lying adjacent each other to thereby define an easy-open spiral seam extending between said opposed ends;

a flexible barrier liner layer in strip form spirally-wound inside said bodywall layer in superimposed position therewith, said liner layer having an expandable joint comprising longitudinal edge portions overlapped with each other, an expandable fold formed by one of said liner layer edge portions being folded on itself and low strength bonding means positioned between said liner layer overlapped edge portions, said liner layer expandable joint being positioned adjacent to and to one side of said easy-open spiral seam and in the direction of tear of said easy-open panel defined by said score cuts;

high strength bonding means positioned between said liner layer and said bodywall layer except in the area between said liner layer expandable joint and slightly beyond the other side of said easy-open spiral seam from said liner layer expandable joint;

a flexible label layer in strip form spirally-wound outside said bodywall layer in superimposed position therewith and having longitudinal edge portions overlapped with each other adjacent and to one side of said easy-open spiral seam, low strength bonding means positioned between said overlapped label layer edge portions, the uppermost of said label layer overlapped edge portions being folded under on itself and having high strength bonding means position between the folds formed therein, the folded uppermost of said label layer overlapped edge portions being positioned in bridging relation to said easy-open spiral seam;

high strength bonding means positioned between said label layer and said bodywall layer;

tab cuts extending through the upper of said label layer edge portions and inwardly from an outer edge thereof past said spiral seam and through said bodywall layer longitudinal edge portion superimposed thereunder to define an easy-open pull tab including both the upper of said label layer edge portions and the inwardly underlying bodywall layer longitudinal edge portion; and score cuts extending through said bodywall layer and extending in diverging lines from said pull tab to define an easy-open panel for said container which is adapted to tear when said pull tab is pulled to easy-open said container.

7. An easy-open container, as set forth in claim 1 or 6, in which said bodywall layer longitudinal edges are in abutting relation forming a butt joint at said easy-open spiral seam.

8. An easy-open container, as set forth in claim 1 or 6, in which said bodywall layer longitudinal edges are skived and overlapped with each other forming a skived joint at said easy-open spiral seam, and in which low strength bonding means is positioned between said overlapped skived bodywall layer longitudinal edges.

9. An easy-open container, as set forth in claim 1 or 6, in which said diverging score cut lines of said easy-open panel extend at 0° to 45° and 90° to 110°, respectively, from the longitudinal edge having said tab cuts extending inwardly therefrom to define an included angle from 45° to 90° in said easy-open panel.

10. An easy-open container, as set forth in claim 4 or 6, in which said low strength bonding means comprises a frangible adhesive, and in which said high strength bonding means comprises a permanent adhesive.

* * * * *